US007798808B2

(12) United States Patent
Kleve

(10) Patent No.: US 7,798,808 B2
(45) Date of Patent: Sep. 21, 2010

(54) SECTIONAL CANDLE APPARATUS

(76) Inventor: Robert Bruce Kleve, 23056 Warner St., Farmington, MI (US) 48336

( * ) Notice: Subject to any disclaimer, the term of this patent is extended or adjusted under 35 U.S.C. 154(b) by 825 days.

(21) Appl. No.: 11/595,762

(22) Filed: Nov. 10, 2006

(65) Prior Publication Data

US 2008/0113308 A1 May 15, 2008

(51) Int. Cl.
*F23D 3/16* (2006.01)
*C10L 5/00* (2006.01)
*F21L 19/00* (2006.01)

(52) U.S. Cl. ..... 431/253; 431/126; 431/288; 431/289; 431/290; 431/325; 362/157; 362/159; 362/161; 264/3.5; 264/3.6; 264/139

(58) Field of Classification Search ..... 431/33, 431/35 M, 126, 288, 289, 290, 324, 325; 362/157, 159, 161; 264/3.5, 3.6, 139; *C10L 5/00; C11C 5/00; F21L 19/00; F21V 31/00; F23D 3/16; F23N 1/00*

See application file for complete search history.

(56) References Cited

U.S. PATENT DOCUMENTS 2,208,279 A * 7/1940 Powers ..... 431/262
2,841,972 A * 7/1958 Weglin ..... 427/273
2,959,950 A * 11/1960 Weglin ..... 431/126
3,283,546 A * 11/1966 Matsui ..... 431/126
3,388,960 A * 6/1968 Cangialosi ..... 431/288
3,706,523 A * 12/1972 Kumm ..... 431/126
3,773,460 A * 11/1973 Tellier ..... 431/289
3,958,917 A * 5/1976 Naz ..... 431/289
4,013,397 A * 3/1977 Neugart ..... 431/291
5,338,187 A * 8/1994 Elharar ..... 431/288
5,433,595 A * 7/1995 Wentzell et al. ..... 431/289
5,597,300 A * 1/1997 Wohl et al. ..... 431/288
6,079,975 A * 6/2000 Conover ..... 431/288
6,096,102 A * 8/2000 Matthai et al. ..... 44/275
6,203,313 B1 * 3/2001 Holmes et al. ..... 431/288
6,234,786 B1 * 5/2001 Wagner ..... 431/295
6,328,935 B1 * 12/2001 Buccellato ..... 422/125
6,347,879 B1 * 2/2002 Prado ..... 362/159
6,461,014 B1 * 10/2002 Lin ..... 362/101

(Continued)

FOREIGN PATENT DOCUMENTS

EP 675320 A1 * 10/1995

(Continued)

*Primary Examiner*—Steven B McAllister
*Assistant Examiner*—Daniel E Namay
(74) *Attorney, Agent, or Firm*—Quinn Law Group, PLLC

(57) ABSTRACT

An upwardly extending sectional candle is provided. The candle includes adjacent upper and lower wax sections stacked vertically relative to each other, each wax section having a thickness. The candle also includes a spacer formed from a non-flammable material. The spacer has a first surface, a second surface, and a thickness, wherein the first and second surfaces have a non-flat shape. The spacer contacts the upper wax section at the first surface and the lower wax section at the second surface. Each adjacent upper and lower wax section has a wick embedded in, and extending vertically through each wax section. The adjacent upper and lower wax sections are configured to be separated into individual wax sections at the spacer, thus exposing a like-new clean wax surface of the at least one of the upper and lower individual wax sections after the candle is separated.

16 Claims, 5 Drawing Sheets

U.S. PATENT DOCUMENTS

| | | | | |
|---|---|---|---|---|
| 6,551,099 | B1 * | 4/2003 | Kapinski | 431/288 |
| 6,592,637 | B2 * | 7/2003 | McGee et al. | 44/275 |
| 6,716,026 | B1 * | 4/2004 | Beougher | 431/290 |
| 6,805,551 | B1 * | 10/2004 | Feuer | 431/35 |
| 7,040,888 | B2 * | 5/2006 | Keiffer et al. | 431/35 |
| 7,086,752 | B1 * | 8/2006 | Feuer | 362/161 |
| 7,175,298 | B2 * | 2/2007 | Schou | 362/166 |
| 7,578,670 | B2 * | 8/2009 | Keiffer et al. | 431/35 |
| 2001/0001706 | A1 * | 5/2001 | Orlandi | 431/289 |
| 2002/0022205 | A1 * | 2/2002 | Elliott et al. | 431/35 |
| 2003/0101639 | A1 * | 6/2003 | Schinski | 44/275 |
| 2004/0091829 | A1 * | 5/2004 | Mack et al. | 431/35 |
| 2005/0277075 | A1 * | 12/2005 | Keiffer et al. | 431/35 |
| 2006/0292508 | A1 * | 12/2006 | Reisman et al. | 431/289 |
| 2006/0292509 | A1 * | 12/2006 | Reisman et al. | 431/289 |
| 2007/0048684 | A1 * | 3/2007 | Cole et al. | 431/291 |
| 2008/0020335 | A1 * | 1/2008 | Carlson | 431/35 |
| 2008/0057452 | A1 * | 3/2008 | Wade | 431/35 |
| 2008/0070174 | A1 * | 3/2008 | Moeller | 431/289 |
| 2008/0076081 | A1 * | 3/2008 | Keiffer et al. | 431/35 |
| 2009/0029304 | A1 * | 1/2009 | Steinmann et al. | 431/289 |

FOREIGN PATENT DOCUMENTS

| | | | |
|---|---|---|---|
| JP | 06330082 | A * | 11/1994 |
| JP | 2003089798 | A * | 3/2003 |

* cited by examiner

SECTIONAL CANDLE APPARATUS

The invention relates to making candles in sections.

It is an object of the invention to provide a novel wax candle made containing non-flammable and non-wax material thin spacers which enables the owner of the candle to separate the candle in sections as the candle burns down to the spacer.

As the candle burns downwardly, in normal circumstances, the upper unburned portion of the candle will burn to a hollow recessed portion. Before the hollow recessed portion burns fully downward to the spacer, the candle may be extinguished and the hollow recessed portion may be separated cleanly at the spacer and removed along with the spacer, so that the remaining lower unburned portion of the candle will have an even uppermost surface rather than the uneven hollowed out surface so as to once again resemble a new shorter candle.

FIG. 1 is a perspective view of the assembled candle with the spacers there between.

FIG. 3 is a perspective view of the first alternate form of the assembled candle with the spacers there in between.

Figure 1:
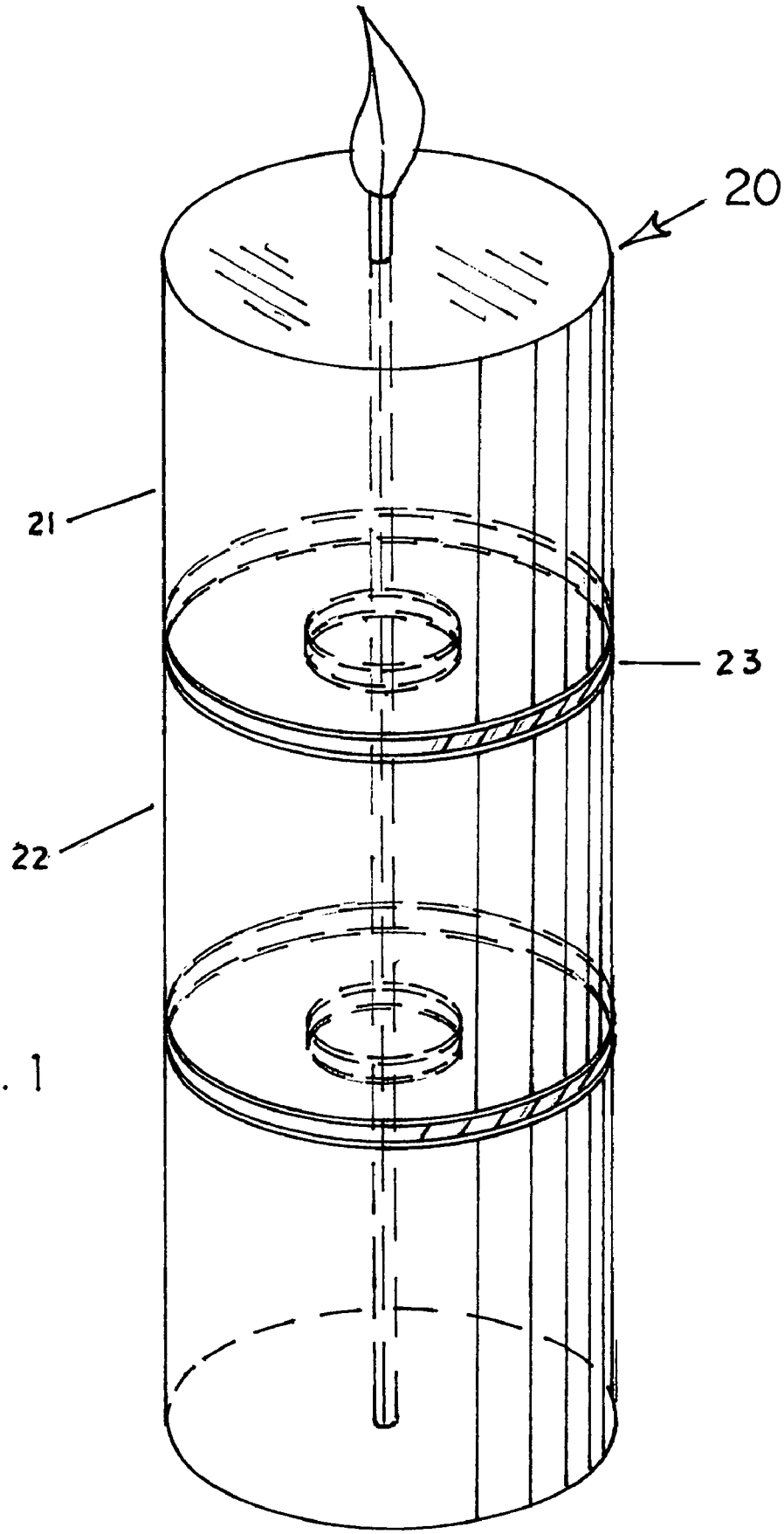
Figure 2:
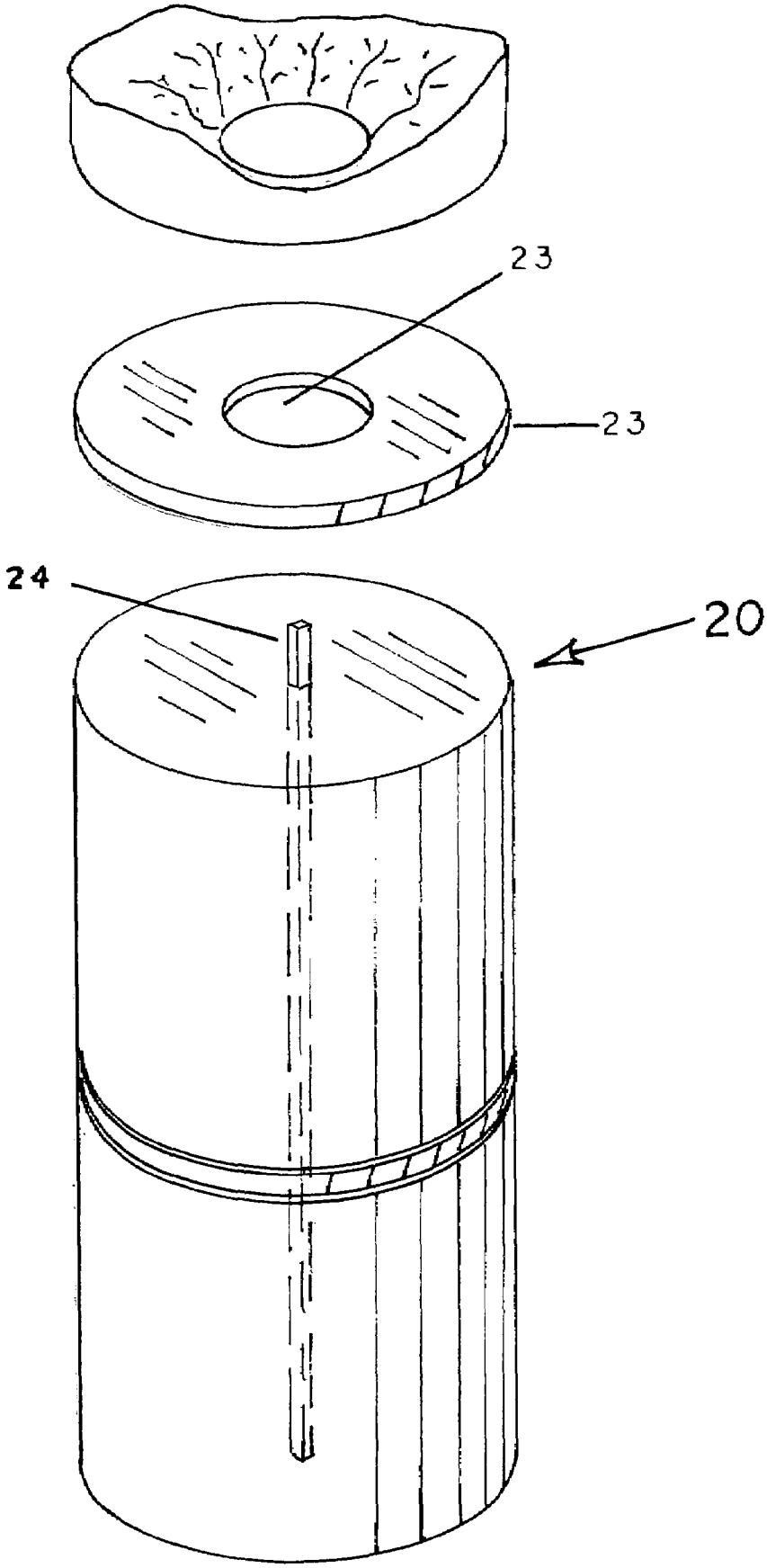
FIG. 2 is a perspective view of the spacer candle after the removing the partially unburned and recessed candle portion and the spacer and re-igniting the remaining candle.

Referring more particularly to the drawings, in FIG. 1 the spacer candle invention 20 is illustrated assembled with wax sections 21 and 22 with a plate like spacer 23 fitted between the wax sections 21 and 22.

The non-wax non-flammable material such as flat plate-like spacers may be provided in the candle so that the candle may be easily separated into sections. In separating the candle into sections, provision may be made to enable the wick to be cut by some means. A separate wick may be provided for each section, or it may be constructed as one single continuous wicks as several wicks stacked together in various forms.

The advantage to forming the candles into several sections, among other things, before the candle burns fully to the spacer, the remaining, unburned portion of the candle, in normal circumstances will burn to a hollow recessed portion. This leaves an ugly, unsightly appearance to the candle and undesirably obstructs the light radiating outwardly from the candle flame. By providing for a spacer, this hollow recessed portion may be broken off cleanly at the spacer, so that the top of the candle will have an even like-new surface rather than a hollowed out surface just as though it was a new candle.

The spacer can be in a flat plate shape with removed center portion 23 and can be molded into the overall candle. The spacer 23 can be in a flat or waved plate shape with removed center portion 23' which has an overall surface area less than that of the adjacent sections of the candle so that portions of the wax between adjoining sections will adhere together after molding to hold the candle together with the spacer contained within. The spacer preferably has the center area 23' cut out so that a single wick 24 may be used. Further the wax of one section surrounding the wick may adhere to the wax of the next section surrounding the wick through the center area 23'. The adhering wax sections provide structure for the candle through the center area until the candle is burned down and the wick is near the spacer. At which time, the upper section may be turned free from the next section and the spacer has been removed and the remaining wick projecting from the unburned section remains contiguous therein.

Figure 3:
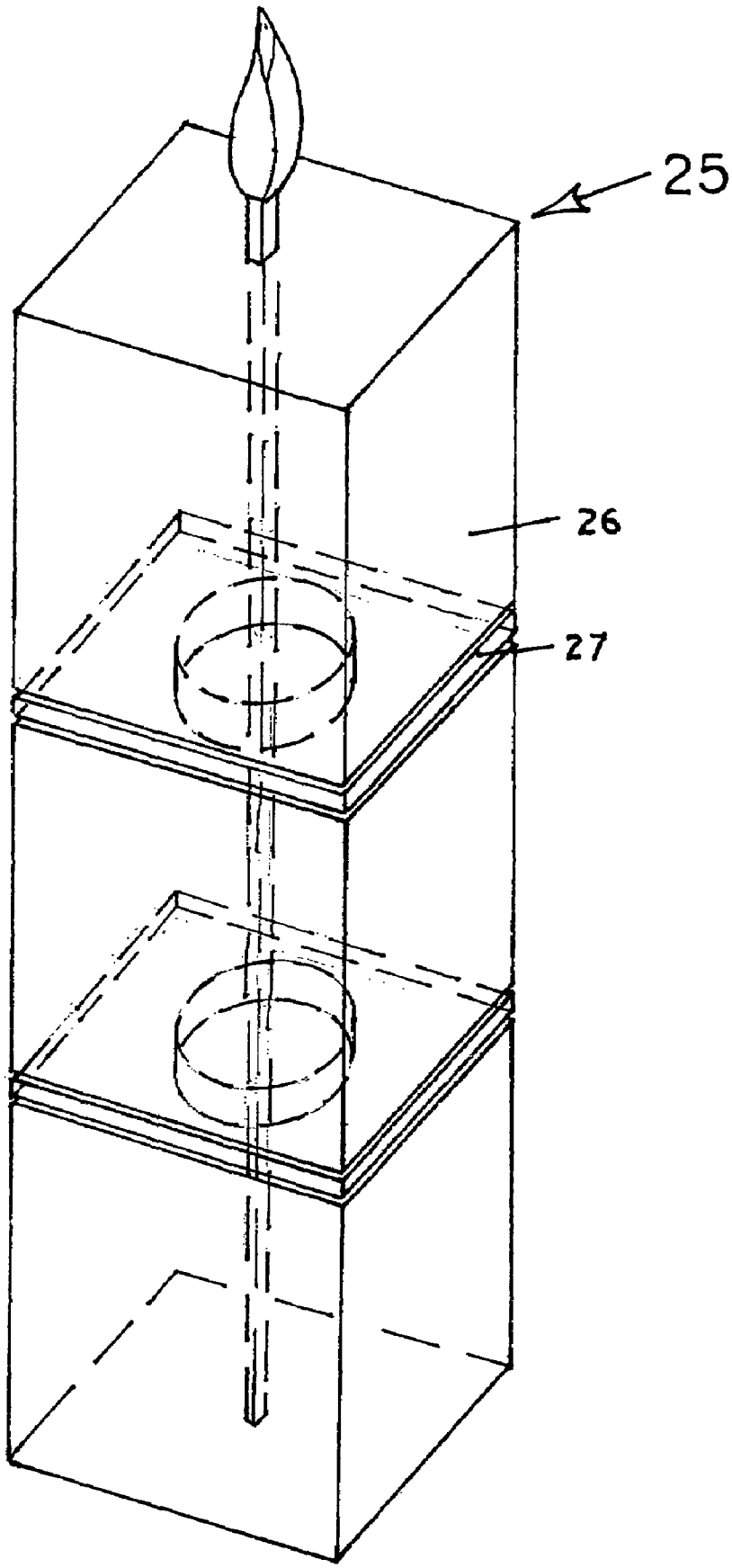
Figure 4:
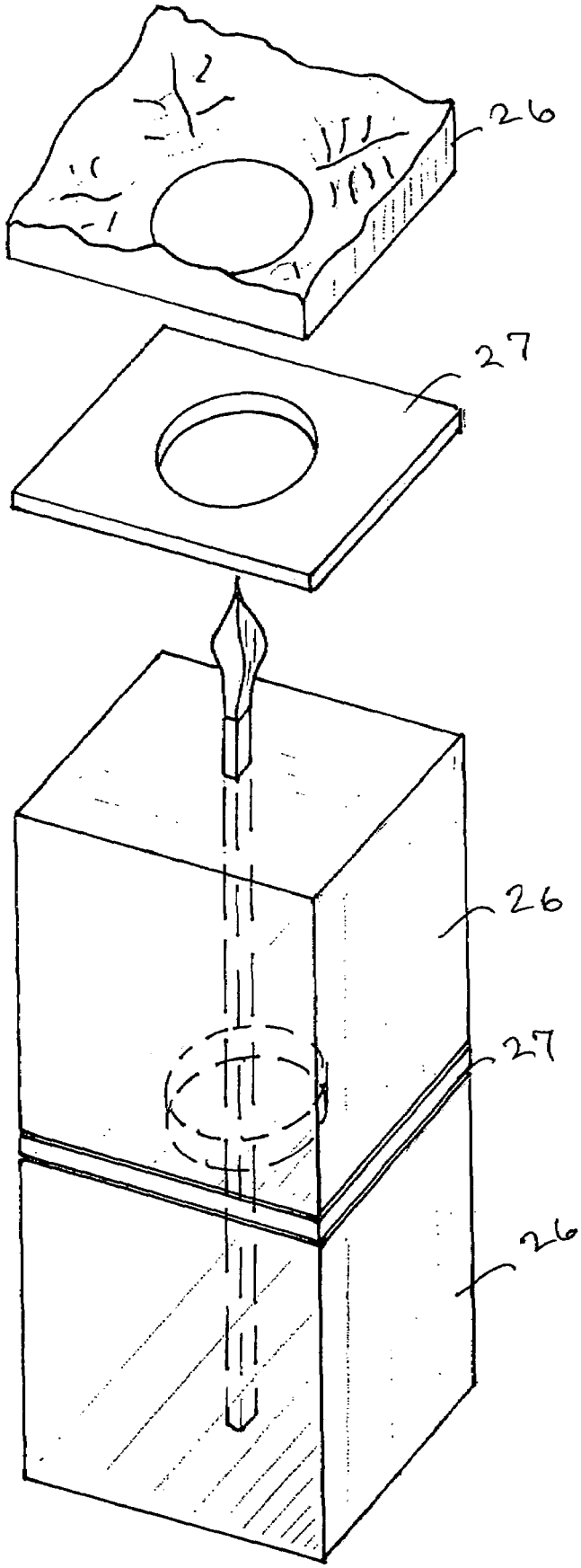
FIG. 4 is a perspective view the first alternate form of the spacer candle after the removing the partially unburned and recessed candle portion and the spacer and re-igniting the remaining candle.
Figure 5:
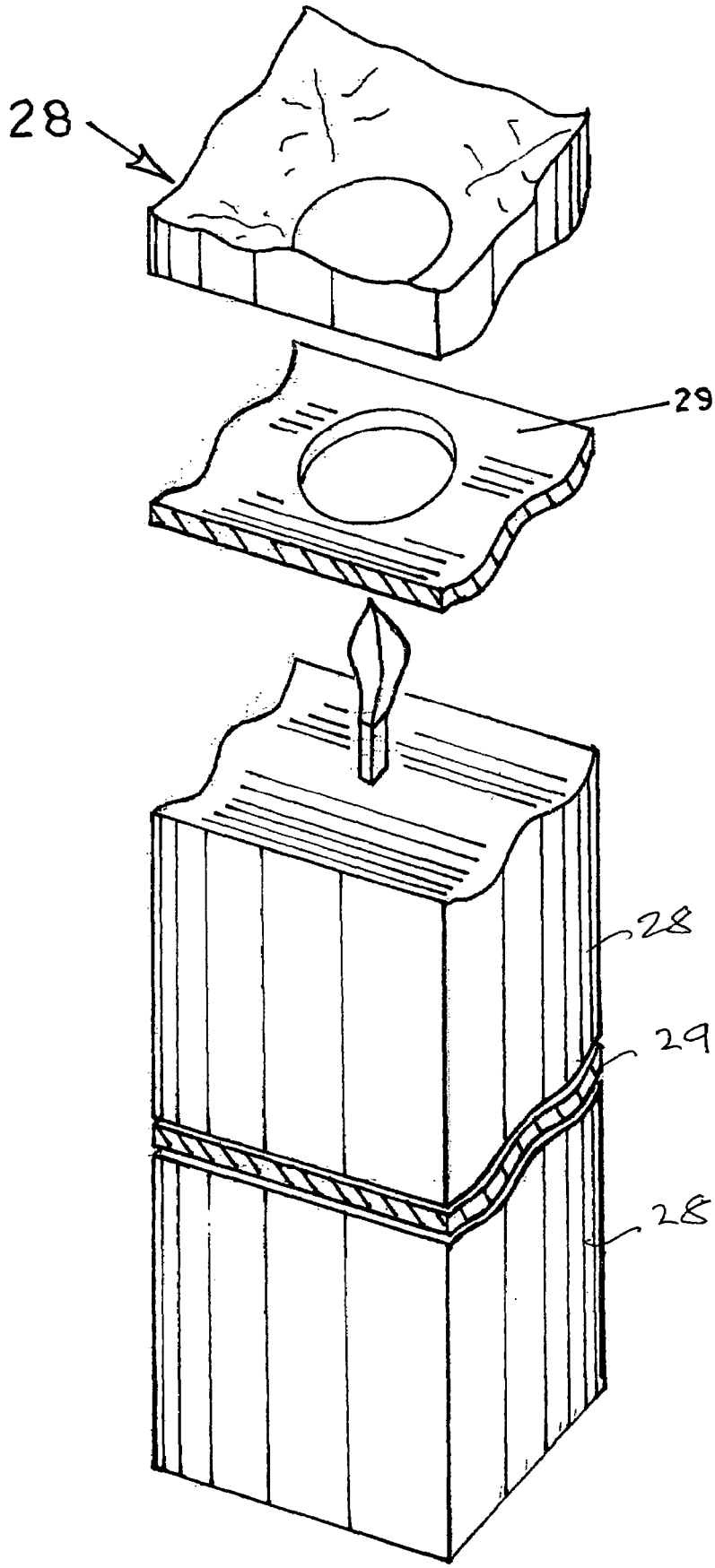
FIG. 5 is a perspective view of the second alternate form of the spacer candle after the removing the partially unburned and recessed candle portion and the spacer and re-igniting the remaining candle.

As a first alternate form of the invention of the spacer candle invention 25, the candle may be made in a non round shape such a square or rectangular such as shown in FIGS. 3 and 4 and designated by the numeral 25 wherein the candle portion 26 is square and the spacer plate 27 is square. This is being done as an artistic variation of original form of the invention.

As a second alternate form of the invention of the spacer candle invention 28, has spacer plates 29 constructed in a waved or non-flat configuration. This is being done as an artistic variation of original form of the invention.

It will be obvious that various changes and departures may be made to the invention without departing from the spirit and scope thereof and accordingly it is not intended that the invention be limited to that specifically described in the specification or as illustrated in the drawings but only as set forth in the appended claims wherein:

What is claimed is:

1. A method for utilizing and separating an upwardly extending candle, the method comprising:

igniting and burning a candle having a wick, adjacent upper and lower wax sections stacked vertically relative to each other, a wax portion connecting the upper and lower wax sections, each wax section having a thickness, and a spacer formed from a non-flammable material disposed between the upper and lower wax sections, the spacer having a first surface in contact with the upper wax section, a second surface in contact with the lower wax section, a thickness, and an open center portion, the wick extends centrally through each of the upper wax section, the spacer, and the lower wax section, and the wax portion extends through the center portion of the spacer and connects the upper and lower wax section;

separating the upper and lower wax sections and breaking the wax portion at the spacer; and exposing a clean wax surface of the lower wax section by removing the spacer.

2. The method of claim 1, further comprising re-igniting the candle after the like-new clean wax surface of the lower wax section has been exposed.

3. The method of claim 1, further comprising extinguishing the candle prior to fully burning down the upper wax section.

4. The method of claim 1, wherein the wick is embedded in and extends vertically through each adjacent upper and lower wax section, and said separating the upper and lower wax sections includes separating the wick.

5. The method of claim 1, wherein said separating the upper and lower wax sections is accomplished after the upper wax section has burned down to a hollow recess such that the wax portion is burned.

6. The method of claim 1, wherein the wick is continuous through each of the upper wax section, the wax portion, and the lower wax section.

7. The method of claim 1, wherein the wick is constructed of separate sections, and one wick section is arranged within each of the upper wax section and the lower wax section.

8. The method of claim 1, wherein the first and second surfaces have a non-flat shape.

9. The method of claim 1, wherein the thickness of the spacer is smaller than the thickness of each of the adjacent upper and lower wax sections.

10. The method of claim 1, wherein the upper and lower wax sections, and the spacer each have a cross-sectional shape, and the cross-sectional shapes of the upper wax sections, the lower wax section, and the spacer substantially match.

11. The method of claim 10, wherein the substantially matching cross-sectional shape of the spacer and of the adjacent upper and lower wax sections is one of a substantially round and a substantially rectangular shape.

12. A method for separating into sections a single upwardly extending candle, the method comprising:

grasping a candle having a wick, adjacent upper and lower wax sections stacked vertically relative to each other, a wax portion connecting the upper and lower wax sections, each wax section having a thickness, and a spacer formed from a non-flammable material disposed between the upper and lower wax sections, the spacer having a first surface in contact with the upper wax section, a second surface in contact with the lower wax section, a thickness and an open center portion, the wick is constructed of separate sections with one wick section arranged vertically within each of the upper wax section and the lower wax section, and the wax portion extending through the center portion of the spacer;

separating the upper and lower wax sections, breaking the wax portion and separating the wick at the spacer; and exposing a clean wax surface of the lower wax section by removing the spacer.

13. The method of claim 12, wherein the wick extends centrally through each of the upper wax section, the spacer, and the lower wax section.

14. The method of claim 13, wherein the wick is continuous through each of the upper wax section, the wax portion, and the lower wax section.

15. The method of claim 12, wherein the first and second surfaces have a non-flat shape.

16. The method of claim 12, wherein the upper and lower wax sections, and the spacer each have a cross-sectional shape, and the cross-sectional shapes of the upper wax sections, the lower wax section, and the spacer substantially match.

* * * * *